US006589140B1

(12) United States Patent
Hsu

(10) Patent No.: US 6,589,140 B1
(45) Date of Patent: Jul. 8, 2003

(54) POGO STICK WITH A COUNTING MECHANISM

(76) Inventor: Cheng-Hsiung Hsu, No.29-18, Ko-Chien Lane, Lu-Kang Township, Chang Hua Hsien (TW)

( * ) Notice: Subject to any disclaimer, the term of this patent is extended or adjusted under 35 U.S.C. 154(b) by 0 days.

(21) Appl. No.: 10/036,241

(22) Filed: Jan. 4, 2002

(51) Int. Cl.[7] ..... A63B 25/08

(52) U.S. Cl. ..... 482/77; 482/909

(58) Field of Search ..... 482/77, 51, 148, 482/121–123, 908, 5–7, 909; 280/218

(56) References Cited

U.S. PATENT DOCUMENTS 3,181,862 A * 5/1965 White ..... 482/77
5,011,136 A * 4/1991 Rennex ..... 482/51
6,168,555 B1 * 1/2001 Fetterleigh et al. ..... 482/77

* cited by examiner

*Primary Examiner*—Stephen R. Crow
(74) *Attorney, Agent, or Firm*—Harrison & Egbert

(57) ABSTRACT

A pogo stick or jump leg is used for amusement and exercise and is formed of a cylindrical body, a handle frame, a footboard, a landing rod, and a counting mechanism which is disposed in the handle frame and is formed of a counter, a drive member, and a linking member. The linking member is actuated by the landing rod in motion to activate the drive member so as to drive the counter for keeping count of jumps made by the landing rod.

1 Claim, 7 Drawing Sheets

POGO STICK WITH A COUNTING MECHANISM

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a device for amusement and exercise, and more particularly to a jumping device which is provided with a counting mechanism to exhibit the number of jumps made by the user of the device.

BACKGROUND OF THE INVENTION

As shown in FIG. 1, a prior art pogo stick or jump leg 10 comprises a handle frame 11, a footboard 12, and a landing rod 14. The handle frame 11 is provided with a cylindrical slot 13 extending downwards to fasten to the footboard 12. The landing rod 14 is extended from the handle frame 11 such that the landing rod 14 is put through the cylindrical slot 13 and the footboard 12 to make contact with the ground surface. The landing rod 14 is provided with a compression spring 16 fitted thereover. A user of the prior art jump leg 10 stands on the footboard 12 such that both hands of the user hold the handle frame 11. The user does the jumping with the jump leg 10 for amusement and exercise. The prior art jump leg 10 is not provided with a means to count automatically the number of jumps made by the user.

BRIEF SUMMARY OF THE INVENTION

The primary objective of the present invention is to provide a pogo stick or jump leg with a counting mechanism to exhibit the number of jumps automatically.

In keeping with the principle of the present invention, the foregoing objective of the present invention is achieved by the jump leg comprising a main body and a counting mechanism. The main body comprises a handle frame, a footboard, a cylindrical slot, a landing rod, and a compression spring. The counting mechanism is mounted in the handle frame and is formed of a counter, a drive member, and a linking member. As the jump leg is put into action, the linking member is pushed by the top end of the landing rod repeatedly such that the linking member actuates the drive member to be engaged with a driving gear of the counter. The number of jumps is exhibited by the numbered wheels which are engaged with the driving gear of the counter.

The features and the advantages of the present invention will be more readily understood upon a thoughtful deliberation of the following detailed description of the present invention with reference to the accompanying drawings.

DETAILED DESCRIPTION OF THE INVENTION

Figure 1:
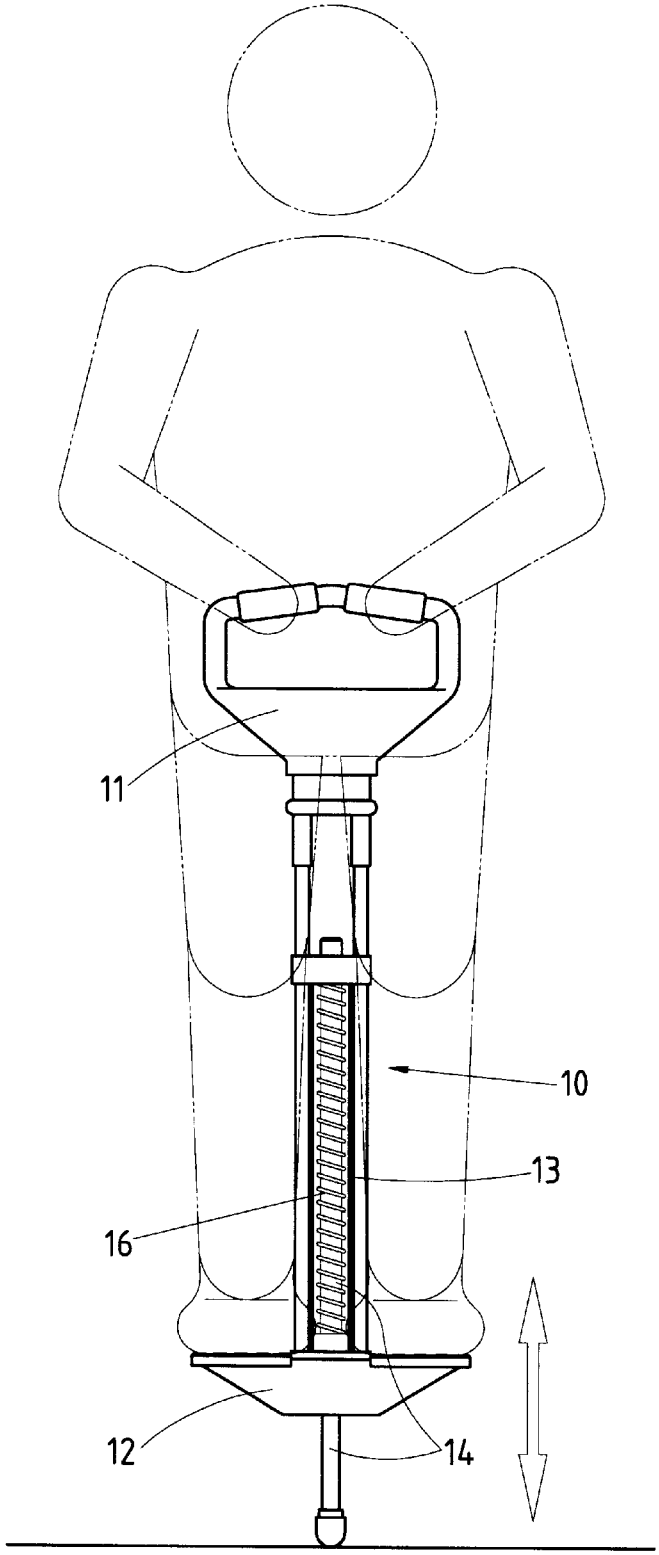
FIG.1 PRIOR ART
FIG. 1 shows a schematic view of a jump leg of the prior art in use.
Figure 2:
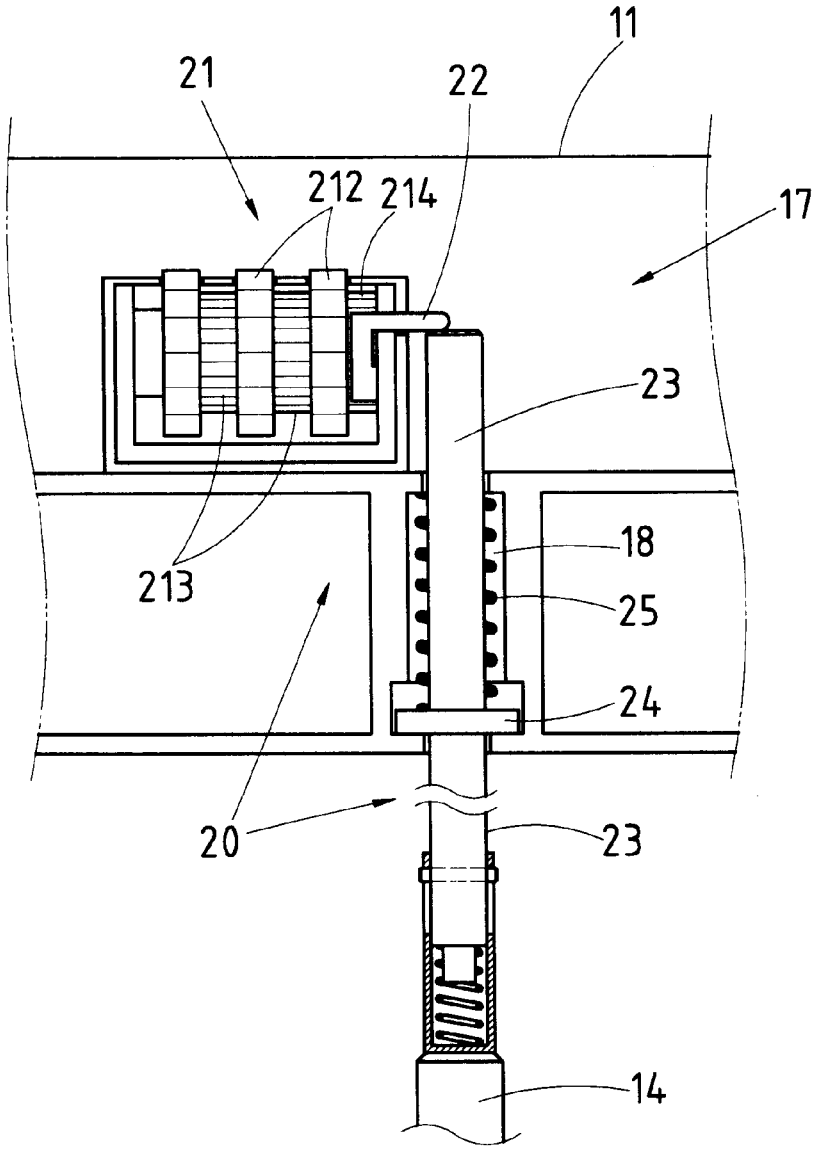
FIG. 2 shows a sectional view of the counting mechanism of the jump leg of the present invention.

As shown in FIGS. 2–7, a pogo stick or jump leg embodied in the present invention is basically similar in structure and function to the prior art jump leg as shown in FIG. 1, with the difference being that the jump leg of the present invention comprises a counting mechanism 20 for keeping count of jumps of the jump leg of the present invention.

The jump leg of the present invention is formed of a cylindrical body 10, a handle frame 11 extending from the top end of the cylindrical body 10, a footboard (not shown in the drawings) fastened to the bottom end of the cylindrical body 10, a receiving space 13 located in the interior of the cylindrical body 10 such that the receiving space 13 is extended through both longitudinal ends of the cylindrical body 10, and a landing rod 14 provided with a compression spring 16 fitted thereover. The landing rod 14 is movably received in the receiving space 13 such that the bottom end of the landing rod 14 is in contact with a surface.

The handle frame 11 is provided in the interior with a receiving slot 17 in which the counting mechanism 20 is disposed. The counting mechanism 20 is formed of a counter 21, a drive member 22, and a linking member 23.

The counter 21 comprises a plurality of counting wheels 212, each having Arabic numerals. The counting wheels 212 are corresponding in location to a window 18 of the handle frame 11 such that the Arabic numerals of the counting wheels 212 can be seen via the window 18. The counting wheels 212 are linked by a plurality of linking gears 213 and are driven by a driving gear 214.

Figure 4:
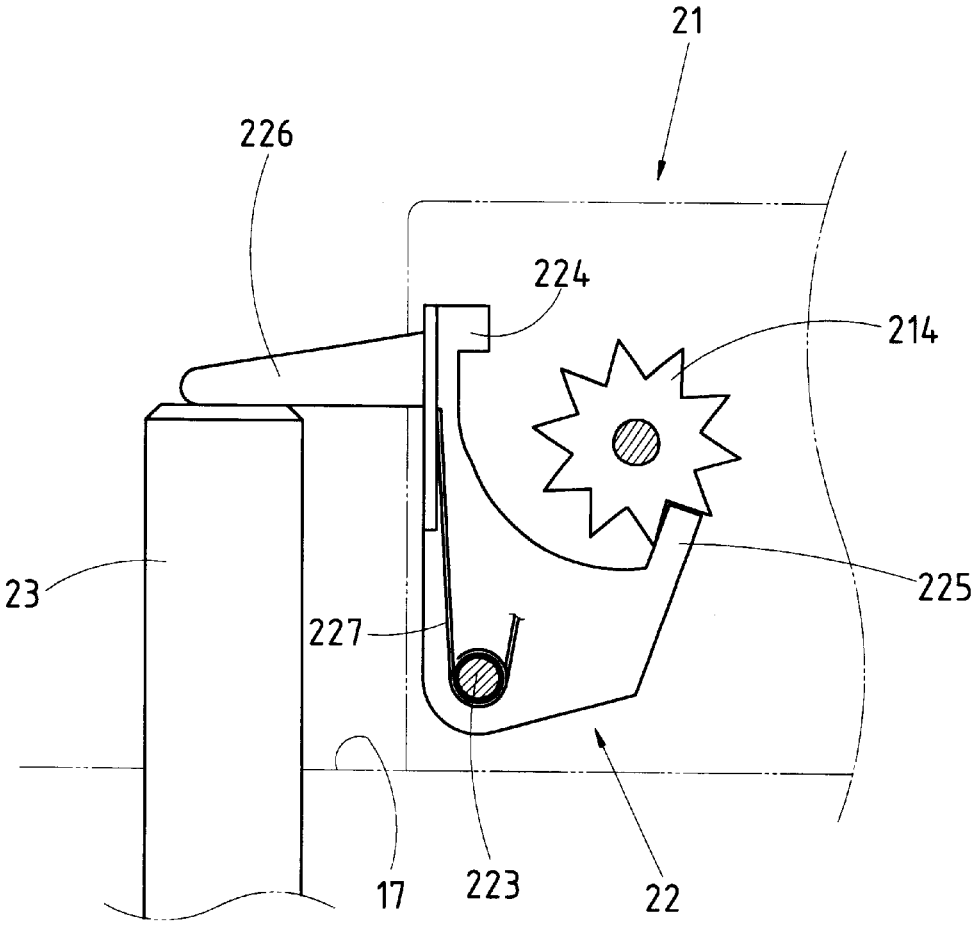
FIGS. 4–6 are schematic views showing the drive member and the driving gear of the counting mechanism of the jump leg of the present invention in the state of operation.
Figure 5:
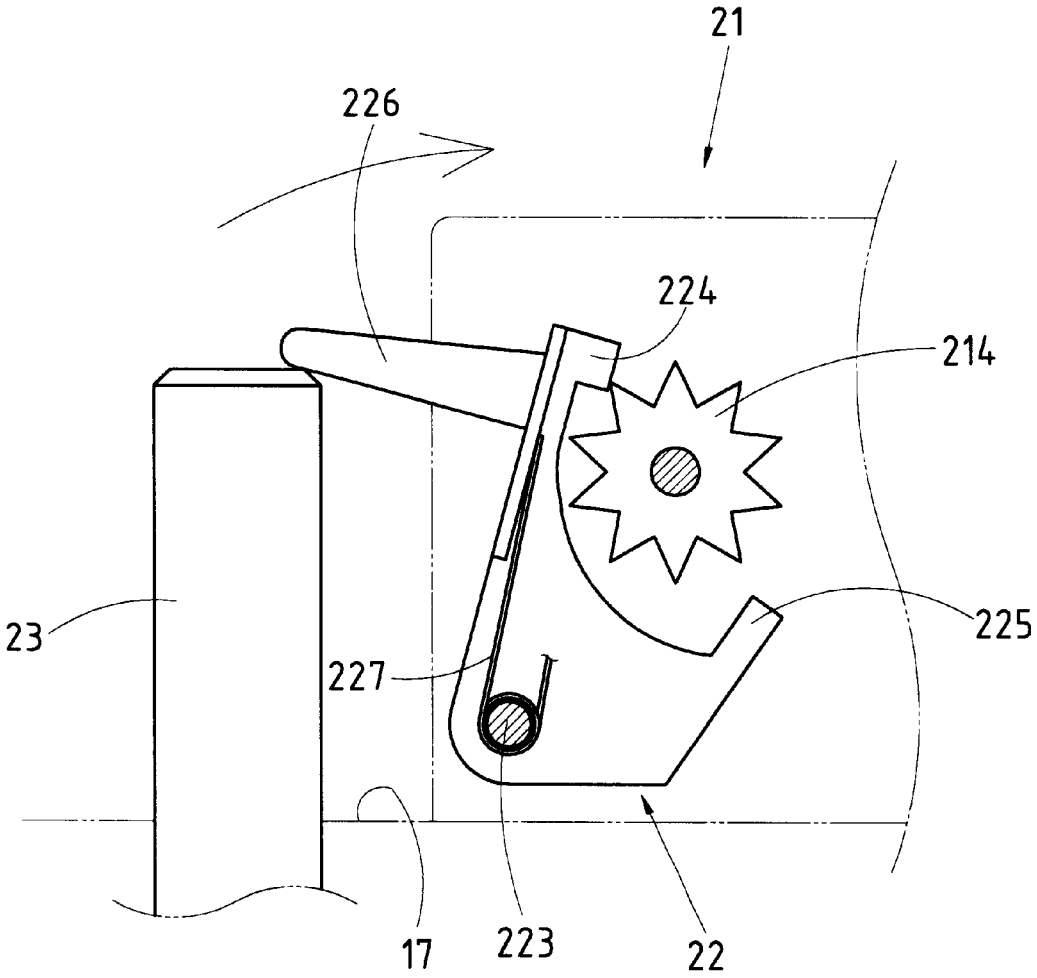
Figure 6:
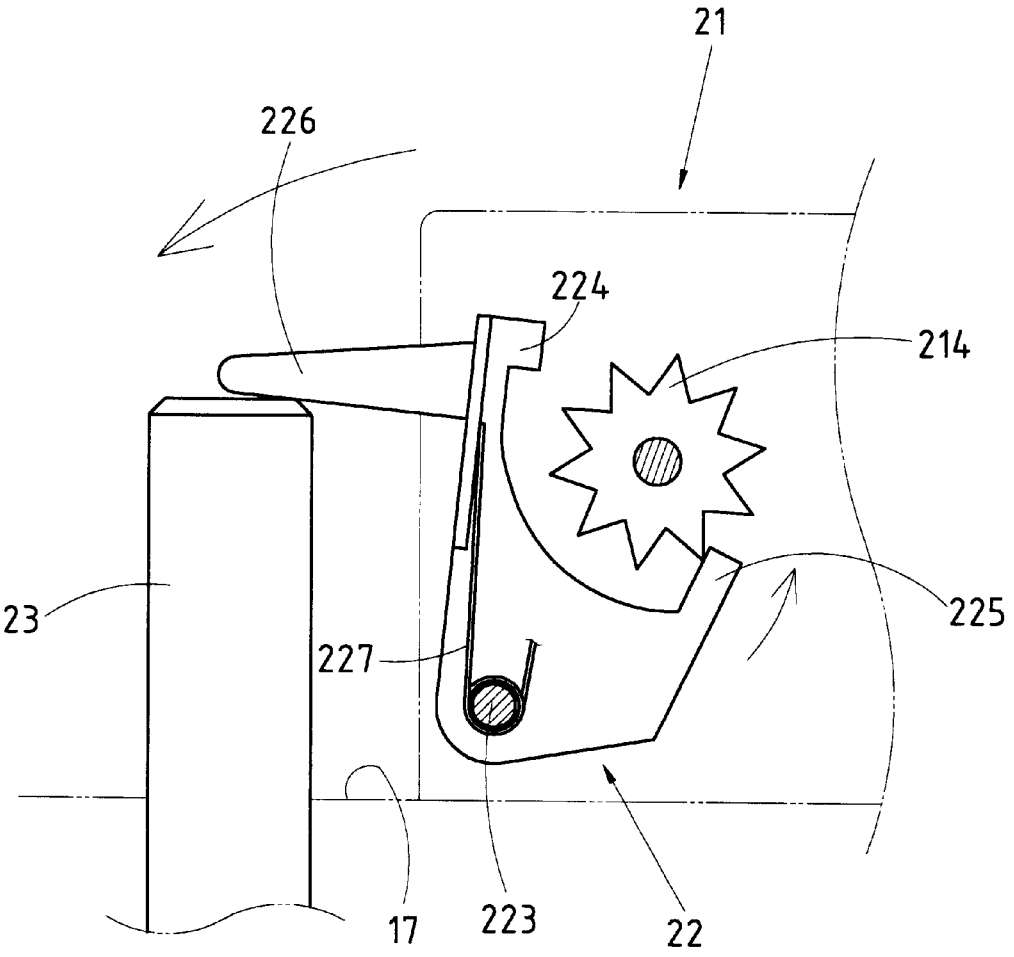
Figure 7:
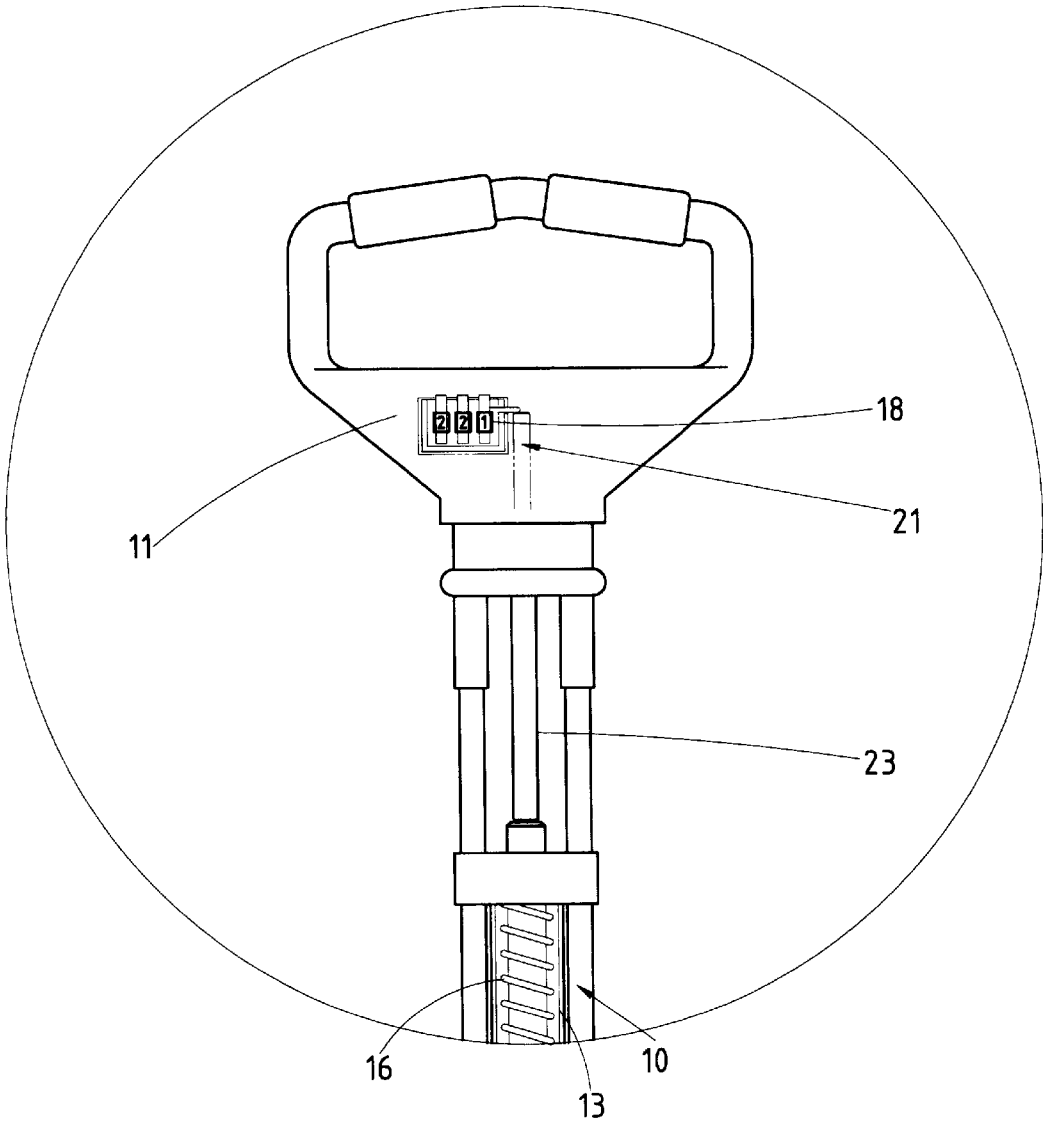
FIG. 7 shows a partial front view of the jump leg of the present invention.

The drive member 22 is formed of a pivoting portion 223, an upper drive portion 224, a lower drive portion 225, and a moving arm 226, as shown in FIG. 4. The upper drive portion 224 and the lower drive portion 225 are capable of swiveling on the pivoting portion 223 so as to engage the driving gear 214, as illustrated in FIGS. 4, 5, and 6. The drive member 22 is provided with a spring 227 which is used to enable the lower drive portion 225 to be always engaged with the driving gear 214 at the time when the jump leg of the present invention is not in use, as illustrated in FIG. 4.

The linking member 23 is pivotally mounted in a guide slot 18 of the receiving slot 17 of the handle frame 11 such that the top end of linking member 23 is located under the moving arm 226 of the drive member 22, and that the bottom end of the linking member 23 is located over the top end of the landing rod 14. The linking member 23 is provided at the bottom end with a stop edge 24 for stopping the bottom end of a recovery spring 25 which is fitted over the linking member 23 such that the top end of the recovery spring 25 is stopped by the wall of the top end of the guide slot 18.

Figure 3:
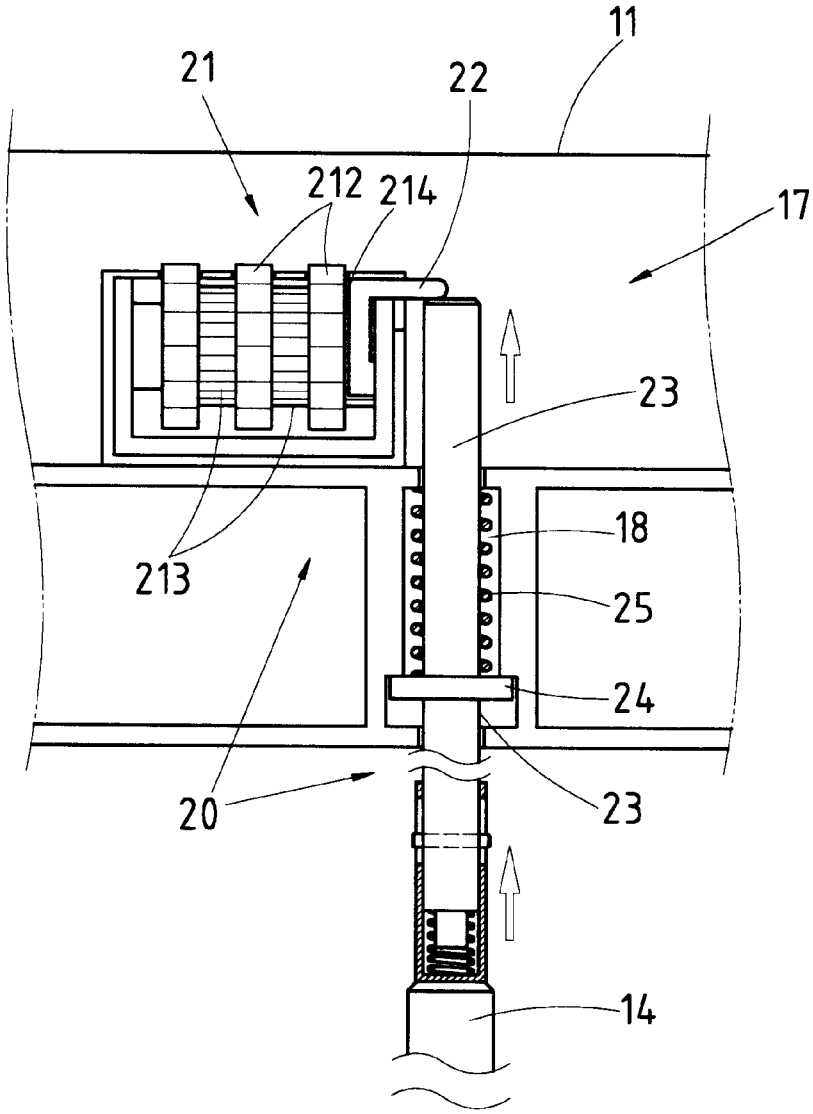
FIG. 3 shows a schematic view of the counting mechanism of the jump leg of the present invention at work.

As illustrated in FIG. 3, when the jump leg of the present invention is in action, the linking member 23 is pushed by the top end of the landing rod 14 to move upwards. As a result, the moving arm 226 of the drive member 22 is pushed by the top end of the linking member 23 so as to cause the upper drive portion 224 of the drive member 22 to engage the driving gear 214, as shown in FIG. 5. When the moving arm 226 is relived of the push of the top end of the linking member 23, the lower drive portion 225 is actuated by the spring force of the spring 227 of the drive member 22 to engage the driving gear 214, as shown in FIG. 6.

I claim:

1. A jumping device for amusement and exercise, comprising:

a cylindrical body provided in an interior with a receiving space extending through both longitudinal ends thereof;

a handle frame extending upwards from a top end of said cylindrical body and comprised of a window and a receiving slot whereby said receiving slot is comprised of a guide slot;

a footboard fastened to a bottom end of said cylindrical body;

a landing rod slidably received in said receiving space of said cylindrical body such that a bottom end of said landing rod is in contact with a surface; and a counting mechanism mounted in said receiving slot of said handle frame and comprised of:

a counter comprising a plurality of counting wheels, each having Arabic numerals, said counting wheels corresponding in location to said window of said handle frame such that the Arabic numerals of said counting wheels can be seen via said window, said counting wheels being linked by a plurality of linking gears and driven by a driving gear;

a drive member comprised of a pivoting portion, an upper drive portion, a lower drive portion, and a moving arm, said upper drive portion and said lower drive portion being turned on said pivoting portion so as to engage said driving gear of said counter whereby said drive member is provided with a spring to enable said lower drive portion of said drive member to keep engaging said driving gear of said counter at the time when said jumping device is not in action; and a linking member mounted pivotally in said guide slot of said receiving slot of said handle frame such that a top end of said linking member is located under said moving arm of said drive member, and such that a bottom end of said linking member is located over a top end of said landing rod, said linking member comprised of a stop edge extending therefrom, and a recovery spring fitted thereover such that a bottom end of said recovery spring is stopped by said stop edge of said linking member and such that a top end of said recovery spring is stopped by a top end wall of said guide slot of said receiving slot of said handle frame whereby said linking member is pushed by the top end of said landing rod in action such that the top end of said linking member pushes said moving arm of said drive member so as to cause said upper drive portion of said drive member to engage said driving gear of said counter, said lower drive portion of said drive member being actuated by a spring force of said spring of said drive member to engage said driving gear of said counter at such time when said moving arm of said drive member is relieved of a pushing force of the top end of said linking member.

* * * * *